US007122963B2

(12) United States Patent
Fujitani

(10) Patent No.: US 7,122,963 B2
(45) Date of Patent: Oct. 17, 2006

(54) PLASMA DISPLAY HAVING A DIELECTRIC LAYER FORMED WITH A RECESSED PART

(75) Inventor: Morio Fujitani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 221 days.

(21) Appl. No.: 10/477,190

(22) PCT Filed: Mar. 5, 2003

(86) PCT No.: PCT/JP03/02574

§ 371 (c)(1),
(2), (4) Date: Nov. 10, 2003

(87) PCT Pub. No.: WO03/075302

PCT Pub. Date: Sep. 12, 2003

(65) Prior Publication Data

US 2004/0174120 A1 Sep. 9, 2004

(30) Foreign Application Priority Data

Mar. 6, 2002 (JP) ..... 2002-059929

(51) Int. Cl.
*H01J 17/49* (2006.01)

(52) U.S. Cl. ..... 313/586; 313/582; 313/587

(58) Field of Classification Search ..... 313/586
See application file for complete search history.

(56) References Cited

U.S. PATENT DOCUMENTS

| | | | | |
|---|---|---|---|---|
| 6,509,689 | B1 * | 1/2003 | Kim et al. | 313/586 |
| 6,525,470 | B1 * | 2/2003 | Amemiya | 313/586 |
| 6,531,820 | B1 * | 3/2003 | Lee et al. | 313/586 |
| 6,611,099 | B1 * | 8/2003 | Murata et al. | 313/582 |
| 6,812,641 | B1 * | 11/2004 | Fujitani et al. | 313/587 |
| 6,822,627 | B1 * | 11/2004 | Uemura et al. | 345/60 |
| 6,831,412 | B1 * | 12/2004 | Amatsuchi | 313/586 |
| 2004/0174119 | A1 * | 9/2004 | Fujitani | 313/586 |

FOREIGN PATENT DOCUMENTS

| | | |
|---|---|---|
| EP | 0 860 849 | 8/1998 |
| EP | 1 030 340 | 8/2000 |
| EP | 1 093 147 | 4/2001 |
| JP | 8-250029 | 9/1996 |
| JP | 10-233171 | 9/1998 |
| JP | 2000-156168 | 6/2000 |
| JP | 2000-200553 | 7/2000 |
| JP | 2000-223032 | 8/2000 |

(Continued)

*Primary Examiner*—Sikha Roy
(74) *Attorney, Agent, or Firm*—Wenderoth, Lind & Ponack, L.L.P.

(57) ABSTRACT

A plasma display device having improved luminous efficiency includes a pair of front and back substrates opposed to each other to form between the substrates a discharge space partitioned by barrier ribs, a plurality of display electrodes, each of which is formed of a scan electrode and a sustain electrode and disposed on the substrate of a front panel to form a discharge cell between the barrier ribs, a dielectric layer formed above the front substrate to cover the display electrodes, and a phosphor layer which emits light by discharge between the display electrodes. The discharge space is filled with mixed gas as discharge gas, the mixed gas includes Xe having a partial pressure of 5% to 30%, and the dielectric layer is formed with, at its surface closer to the discharge space, a recessed part in each discharge cell.

3 Claims, 9 Drawing Sheets

FOREIGN PATENT DOCUMENTS

| | | | | |
|---|---|---|---|---|
| JP | 2000-228149 | | | 8/2000 |
| JP | 2000-285811 | | | 10/2000 |
| JP | 2000-306517 | | | 11/2000 |
| JP | 2000-315459 | | | 11/2000 |
| JP | 2001-126628 | | | 5/2001 |
| JP | 2001-135238 | | | 5/2001 |
| JP | 2001-228823 | | | 8/2001 |
| JP | 2001-357784 | | | 12/2001 |
| JP | 2001357784 | A | * | 12/2001 |
| JP | 2002-373589 | | | 12/2002 |
| JP | 2003-51262 | | | 2/2003 |
| JP | 2003-217453 | | | 7/2003 |
| JP | 2003217454 | A | * | 7/2003 |
| WO | 00/45412 | | | 8/2000 |

* cited by examiner

FIG. 13 PRIOR ART

PLASMA DISPLAY HAVING A DIELECTRIC LAYER FORMED WITH A RECESSED PART

TECHNICAL FIELD

The present invention relates to a plasma display device, utilizing light emission from gas discharge, and which is used in a color television receiver for character or image display, a display or the like.

BACKGROUND ART

Recently, expectations have run high for large-screen, wall-hung televisions as interactive information terminals. There are many display devices for those terminals, including a liquid crystal display panel, a field emission display and an electroluminescent display, and some of these devices are commercially available, while the others are under development. Of these display devices, a plasma display panel (hereinafter referred to as "PDP" or "panel") is a self-emissive type and capable of beautiful image display. Because the PDP can easily have, for example, a large screen, the display using the PDP has received attention as a thin display device affording excellent visibility and has increasingly high definition and an increasingly large screen.

The PDP is classified as an AC or DC type according to its driving method and classified as a surface discharge type or an opposing discharge type according to its discharge form. In terms of high definition, large screen size and facilitation of production, the surface discharge AC type PDP has become mainstream under present conditions.

FIG. 13 is a perspective view illustrating the structure of a panel of a conventional plasma display device. As shown in FIG. 13, this PDP is constructed of front panel 1 and back panel 2. Front panel 1 is constructed by forming a plurality of stripe-shaped display electrodes 6, each being formed by a scan electrode 4 and sustain electrode 5 on transparent front substrate 3 such as a glass substrate made of, for example, borosilicate sodium glass by a float process, covering display electrodes 6 with dielectric layer 7, and forming protective film 8 made of MgO over dielectric layer 7. Scan electrode 4 and sustain electrode 5 are formed of respective transparent electrodes 4*a*, 5*a* and respective bus electrodes 4*b*, 5*b* formed of Cr—Cu—Cr, Ag or the like, and are electrically connected to respective transparent electrodes 4*a*, 5*a*. A plurality of black stripes or light-shielding films (not shown) are formed, each black stripe or light-shielding film being arranged between and parallel to a respective pair of display electrodes 6.

Back panel 2 has the following structure. On back substrate 9, which is disposed to face front substrate 3, address electrodes 10 are formed in a direction orthogonal to display electrodes 6 and are covered with dielectric layer 11. A plurality of stripe-shaped barrier ribs 12 are formed parallel to address electrodes 10 on dielectric layer 11 with each barrier rib 12 located between adjacent address electrodes 10, and phosphor layer 13 is formed to cover a side of each barrier rib 12 and dielectric layer 11. Typically, red, green and blue phosphor layers 13 are successively deposited for display in color.

Substrates 3, 9 of front and back panels 1, 2 are opposed to each other across a minute discharge space with display electrodes 6 orthogonal to address electrodes 10, and their periphery is sealed with a sealing member. The discharge space is filled with discharge gas, which is made by mixing for example, neon (Ne) and xenon (Xe), at a pressure of about 66,500 Pa (500 Torr). In this way, the PDP is formed.

The discharge space of this PDP is partitioned into a plurality of sections by barrier ribs 12, and a plurality of discharge cells or light-emitting pixel regions are defined by barrier ribs 12 and display and address electrodes 6, 10 that are orthogonal to each other.

FIG. 14 is a plan view illustrating the structure of the discharge cells of the conventional PDP. As shown in FIG. 14, scan and sustain electrodes 4, 5 of display electrode 6 are disposed with discharging gap 14 between these electrodes 4, 5. Light-emitting pixel region 15 is a region surrounded by this display electrode 6 and barrier ribs 12, and non-light-emitting pixel region 16 is an adjoining gap or region between adjacent display electrodes 6.

With this PDP, discharge is caused by periodic application of voltage to address electrode 10 and display electrode 6, and ultraviolet rays generated by this discharge are applied to phosphor layer 13, thereby being converted into visible light. In this way, an image is displayed.

For development of the PDP, higher luminance, higher efficiency, lower power consumption and lower cost are essential. A method of raising a partial pressure of Xe in the discharge gas is generally known as a method for increasing the efficiency. However, raising the Xe partial pressure not only raises discharge voltage, but also causes a sharp increase in emission intensity that results in the luminance reaching a level of saturation. For restraining the luminance from reaching the saturation level, for example, a method of increasing the thickness of the dielectric layer formed above the front substrate is known. However, increasing the thickness of the dielectric layer reduces transmissivity of the dielectric layer, thus reducing the luminance. Moreover, simply increasing the thickness of the dielectric layer raises the discharge voltage. To achieve higher efficiency, discharge in the part shielded from the frontward light needs to be minimized by controlling the discharge. For example, Japanese Patent Unexamined Publication No. H8-250029 discloses a method for improving the efficiency. According to this known method, light emission in a part masked by a metal row electrode is suppressed by increasing the thickness of a dielectric layer above this metal row electrode.

Such a conventional structure, however, has the following problem. Although light emission in a direction perpendicular to the electrode is suppressed, discharge in a direction parallel to the electrode is not suppressed, but extends to the neighborhood of barrier ribs, which lowers electron temperature accordingly. This results in reduced efficiency.

The present invention addresses such problems and aims to improve luminous efficiency.

SUMMARY OF THE INVENTION

To attain the object discussed above, a plasma display device of the present invention includes a pair of front and back substrates opposed to each other to form between the substrates a discharge space partitioned by a barrier rib, a plurality of display electrodes each disposed on the front substrate to form a discharge cell between the barrier ribs, a dielectric layer formed above the front substrate to cover the display electrodes and a phosphor layer which emits light by discharge between the display electrodes. The discharge space is filled with mixed gas as discharge gas, the mixed gas includes Xe having a partial pressure of 5% to 30%, and the dielectric layer is formed with, at a surface thereof closer to the discharge space, a recessed part in each of the discharge cells.

With this structure, the recessed part limits a discharge region, thus limiting discharge current even at the high Xe partial pressure. Accordingly, luminance can be prevented from reaching a level of saturation, and consequently, highly efficient discharge can be realized.

DETAILED DESCRIPTION OF THE PREFERRED EMBODIMENTS

Figure 1:
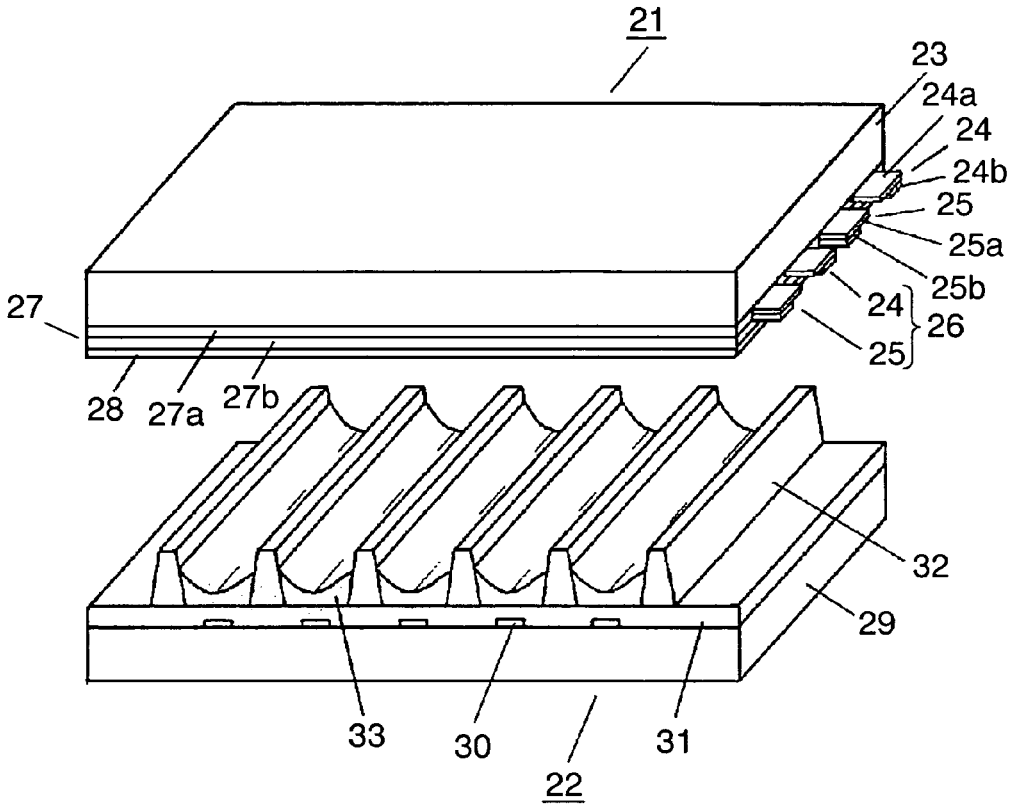
FIG. 1 is a perspective view illustrating the structure of a panel of a plasma display device in accordance with an exemplary embodiment of the present invention.

Referring to FIGS. 1–12, a description will be provided hereinafter of a plasma display device in accordance with an exemplary embodiment of the present invention.

Front panel 21 is constructed by forming a plurality of stripe-shaped display electrodes 26, each being formed by a scan electrode 24 and sustain electrode 25 on transparent front substrate 23 such as a glass substrate made of, for example, borosilicate sodium glass by a float process, covering display electrodes 26 with dielectric layer 27, and forming protective film 28 made of MgO over dielectric layer 27. Dielectric layer 27 includes, for example, two dielectric layers 27*a*, 27*b*. Scan electrode 24 and sustain electrode 25 are formed of respective transparent electrodes 24*a*, 25*a* and respective bus electrodes 24*b*, 25*b*, formed of Cr—Cu—Cr, Ag or the like, and are electrically connected to respective transparent electrodes 24*a*, 25*a*. A plurality of black stripes or light-shielding films (not shown) are formed, each black stripe or light-shielding film being arranged between and parallel to a respective pair of display electrodes 26.

Back panel 22 has the following structure. On back substrate 29, which is disposed to face front substrate 23, address electrodes 30 are formed in a direction orthogonal to display electrodes 26 and are covered with dielectric layer 31. A plurality of stripe-shaped barrier ribs 32 are formed parallel to address electrodes 30 on dielectric layer 31, each stripe-shaped barrier rib being located between a pair of respective address electrodes 30. Phosphor layer 33 is formed between barrier ribs 32 to cover a side of each barrier rib 32 and dielectric layer 31. Typically, red, green and blue phosphor layers 33 are successively deposited for display in color.

Substrates 23, 29 of front and back panels 21, 22 are opposed to each other across a minute discharge space with display electrodes 26 orthogonal to address electrodes 30, and their periphery is sealed with a sealing member. The discharge space is filled with discharge gas or mixed gas, which includes xenon (Xe) and, for example, neon (Ne) and/or helium (He), at a pressure of about 66,500 Pa (500 Torr). In this way, the PDP is formed.

The discharge space of this PDP is partitioned into a plurality of sections by barrier ribs 32, and display electrodes 26 are provided to define a plurality of discharge cells or light-emitting pixel regions between barrier ribs 32. Display electrodes 26 are disposed orthogonal to address electrodes 30.

Figure 2:
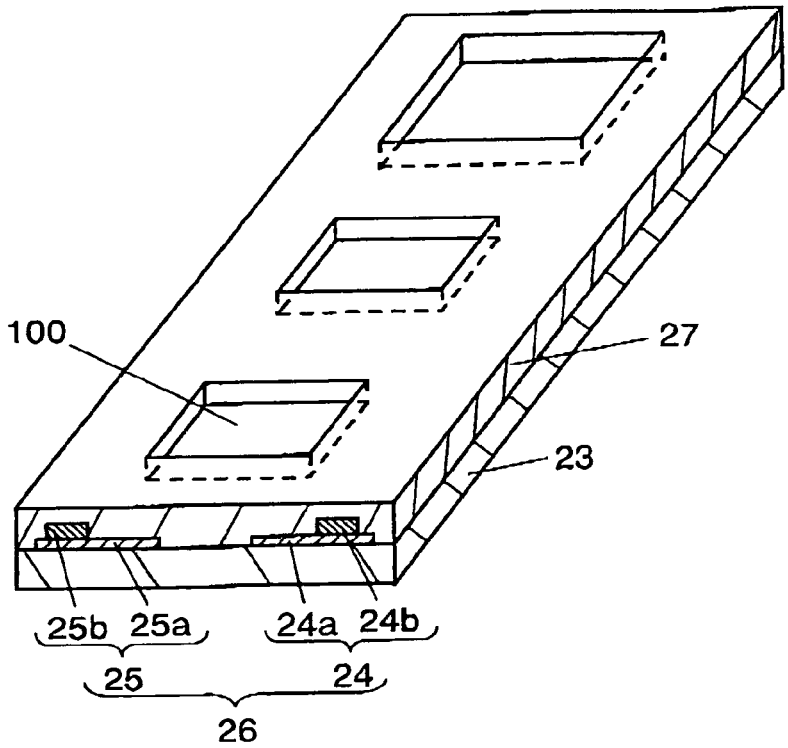
FIG. 2 is a perspective view illustrating the structure of a part corresponding to a discharge cell in the panel of the same plasma display device.
Figure 3:
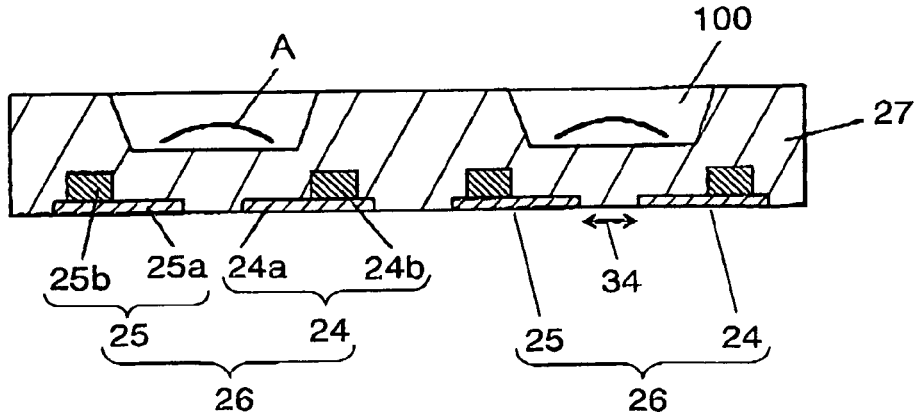
FIG. 3 is a schematic view illustrating an effect of the same plasma display device.

FIGS. 2 and 3 are enlarged views illustrating a part of front panel 21 that corresponds to one discharge cell. As shown in FIGS. 2 and 3, dielectric layer 27 is formed on front substrate 23 to cover display electrodes 26 and is formed with, at its surface closer to the discharge space, recessed part 100 in each discharge cell. This recessed part 100 is located inwardly of barrier ribs 32 (FIG. 1). Preferably, recessed part 100 is located at least 20 m away from barrier ribs 32 (FIG. 1).

In the present invention, the discharge space is filled with the discharge gas or mixed gas including Xe, and a partial pressure of Xe ranges from 5% to 30%. Gas components other than Xe include neon (Ne) and helium (He), and the sum of partial pressures of these gas components can be determined arbitrarily in a range of 70% to 95% which is obtained by deducting the Xe partial pressure.

Figure 4:
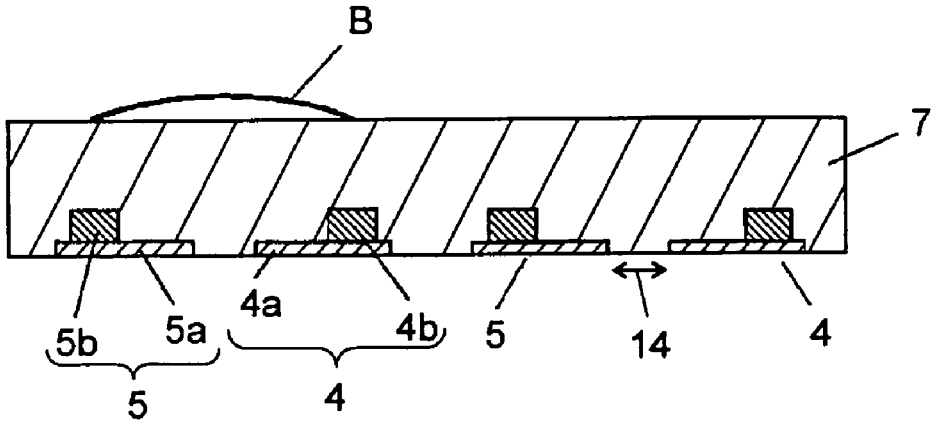
FIG. 4 PRIOR ART
FIG. 4 is a schematic view illustrating discharge of a conventional plasma display device.

Referring to FIGS. 3 and 4, a description will now be provided of control of a discharge region. FIG. 3 illustrates an effect produced by forming recessed parts 100 in dielectric layer 27, while FIG. 4 illustrates a status of a conventional structure having no recessed part. A bottom of recessed part 100 where the thickness of dielectric layer 27 is reduced as shown in FIG. 3 has increased capacitance, so that charges for discharge concentrate on the bottom of recessed part 100 during their formation. Accordingly, the discharge region can be limited as illustrated by A of FIG. 3. Since the thickness of dielectric layer 27 is reduced at the bottom of recessed part 100 as compared with the thickness of this layer 27 at the other part, the discharge originates from this bottom. In other words, in the part other than the bottoms of recessed parts 100, dielectric layer 27 has increased thickness, so that the capacitance reduces in this part, whereby fewer charges exist in this part. Moreover, discharge voltage rises where the thickness of dielectric layer 27 is increased. Because of these effects, the discharge is limited to the bottom of recessed part 100, and the amount of charges formed in recessed part 100 can be controlled arbitrarily by, for example, varying the size of recessed part 100.

In the conventional structure of FIG. 4 that has no recessed part, dielectric layer 7 has uniform thickness, thereby having uniform capacitance at its surface. Accordingly, discharge, as denoted by B of FIG. 4, extends to the neighborhood of electrodes, causing a phosphor corresponding to a part shielded by the electrode to emit the light. This results in reduced efficiency. There are also cases where undesirable discharge easily occurs between the cell and its adjacent cell because charges are formed even in a portion close to the adjacent cell.

For increasing the efficiency of the PDP, a method of raising the partial pressure of Xe in the discharge gas is generally known. However, raising the Xe partial pressure raises the discharge voltage and also causes an increase in the amount of ultraviolet rays that results in luminance easily reaching a level of saturation. Accordingly, the capacitance of the dielectric layer needs to be reduced by increasing the thickness of the dielectric layer for reducing the amount of charges produced by one pulse. However, with increase in thickness of the dielectric layer, transmissivity of the dielectric layer reduces, thus reducing the efficiency. Moreover, simply increasing the thickness raises the discharge voltage further.

The present invention, however, can prevent the luminance from reaching the saturation level even at such a high Xe partial pressure ranging from 5% to 30% in the discharge gas because current is controlled by forming, in each discharge cell, recessed part 100 at the surface of dielectric layer 27 that is closer to the discharge space. In other words, forming recessed part 100 having an optimum size in each light-emitting pixel region limits the discharge region, thus controlling the discharge current. Moreover, the amount of current can be limited arbitrarily by changing the shape or size of recessed part 100. Further, by forming recessed part 100 in each discharge cell and locating each recessed part 100 inwardly of barrier ribs 32, the discharge can be limited only to the bottom of recessed part 100, and accordingly, the discharge can be suppressed in the vicinity of barrier ribs 32.

As described above, the current is controlled by forming recessed part 100 in dielectric layer 27, so that the present invention can use the high Xe partial pressure without changing a circuit or a driving method. Even when dielectric layer 27 is reduced to a thin film in this invention for reducing discharge voltage, the current can be controlled by reducing the size of recessed part 100 of dielectric layer 27. To afford an advantage of this invention, the partial pressure of Xe in the discharge gas may be 5% or more. To allow the discharge voltage drop, which will be enabled by the reduction in dielectric layer thickness, to cancel out the discharge voltage rise, which will be caused by the high Xe partial pressure, the Xe partial pressure preferably ranges from 10% to 20%.

A description will be provided next of other exemplary embodiments of the recessed part formed in the dielectric layer.

Figure 5:
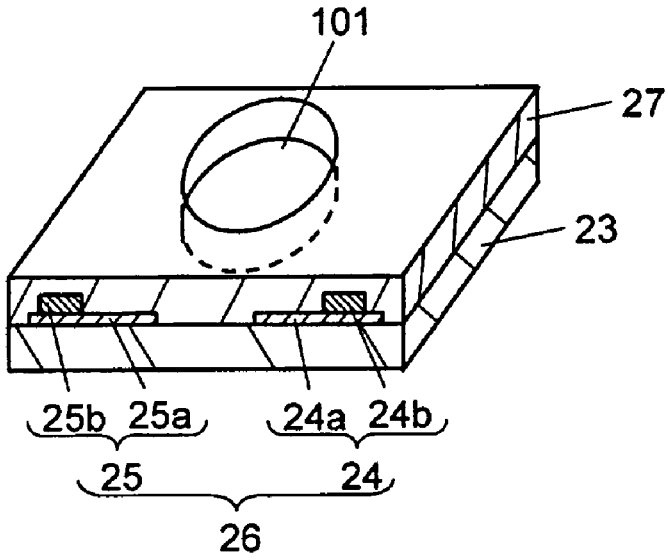
FIG. 5 is a perspective view illustrating the structure of a part corresponding to a discharge cell of a panel of a plasma display device in accordance with another exemplary embodiment of this invention.
Figure 6:
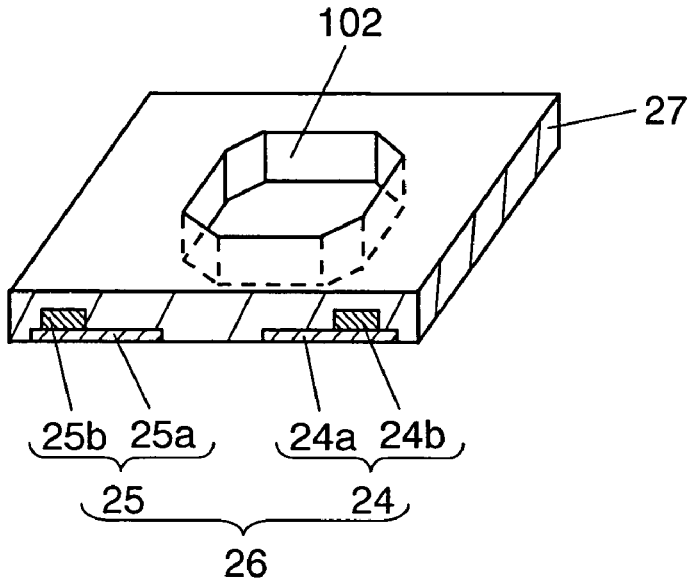
FIG. 6 is a perspective view illustrating the structure of a part corresponding to a discharge cell of a panel of a plasma display device in accordance with still another exemplary embodiment of this invention.
Figure 7:
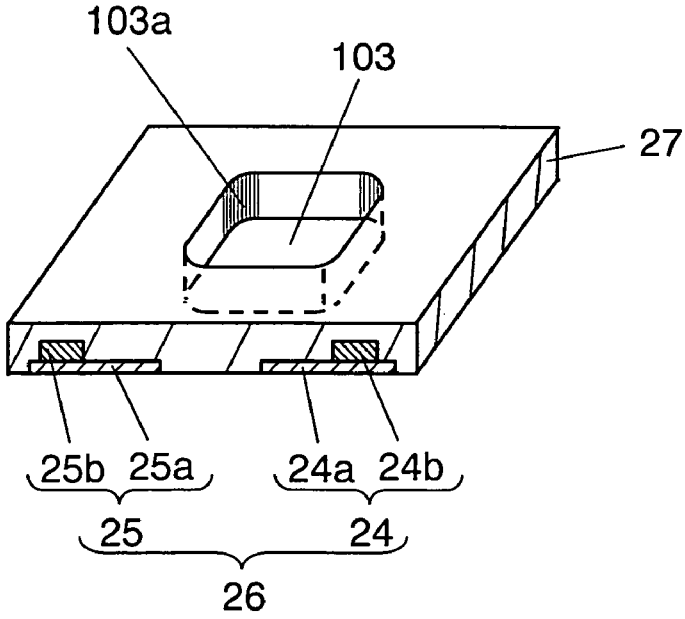
FIG. 7 is a perspective view illustrating the structure of a part corresponding to a discharge cell of a panel of a plasma display device in accordance with yet another exemplary embodiment of this invention.

FIGS. 5–7 each illustrate the structure of a part corresponding to a discharge cell in a PDP of a plasma display device in accordance with another exemplary embodiment of this invention. In the embodiment illustrated by FIG. 5, recessed part 101 is in the shape of a circular cylinder. In the embodiment illustrated by FIG. 6, recessed part 102 is in the shape of a polygon (e.g. an octagon). In the embodiment illustrated by FIG. 7, recessed part 103 is in the shape of a quadratic prism, and four corners of this recessed part 103 are rounded to have curved surfaces 103*a*, respectively.

If the recessed part formed in dielectric layer is recessed part 101 in the shape of the circular cylinder, polygonal (e.g. octagonal) recessed part 102 or recessed part 103 in the shape of the quadratic prism having curved surfaces 103*a* at its respective four corners as described above, the recessed part can be restrained from having a deformed shape resulting from stress which concentrates on its four corners during firing of the dielectric layer.

Instead of having one of the shapes described above, the recessed part may be in the shape of one of those applicable to the present invention, such as a circular cone, an elliptic cylinder, an elliptic cone, a polygonal pyramid or a quadratic pyramid having curved surfaces at its respective four corners.

Figure 8:
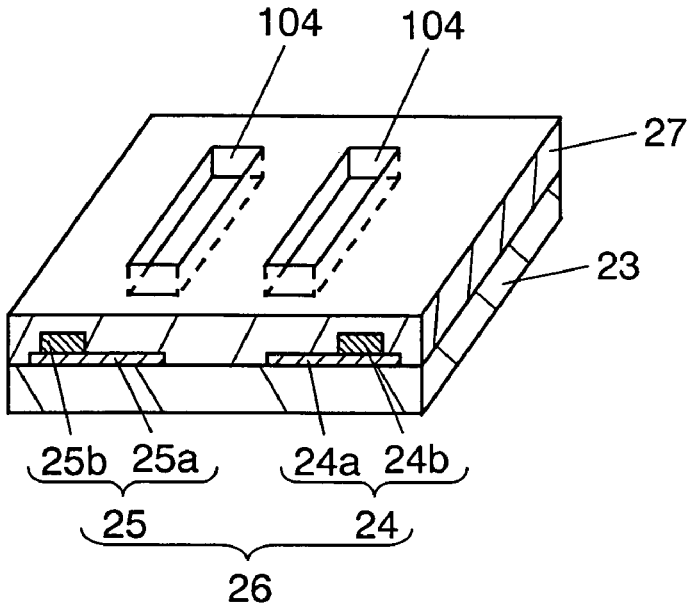
FIG. 8 is a perspective view illustrating the structure of a part corresponding to a discharge cell of a panel of a plasma display device in accordance with a further exemplary embodiment of this invention.
Figure 9:
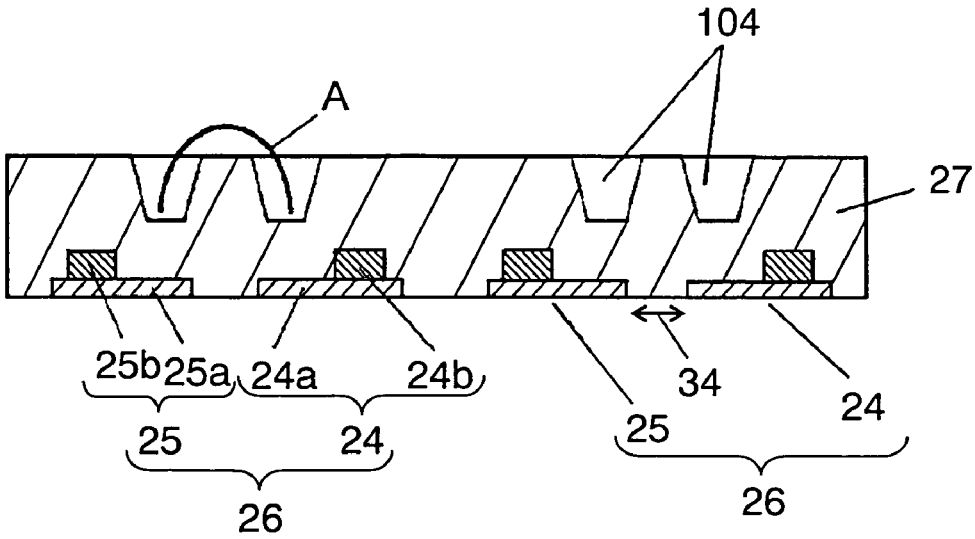
FIG. 9 is a schematic view illustrating an effect of the plasma display device of FIG. 8.

FIG. 8 illustrates the structure of a part corresponding to a discharge cell in a panel of a plasma display device in accordance with another exemplary embodiment of the present invention. In this embodiment, dielectric layer 27 has, at its surface closer to a discharge space, at least two recessed parts 104 in each discharge cell defining a light-emitting pixel region. As shown in FIG. 8, these recessed parts 104 formed are located inwardly of bus electrodes 24*b*, 25*b* and barrier ribs 32 (FIG. 1), and are arranged side by side in parallel with display electrode 26 and are separate from each other like islands. With the structure of this embodiment, discharge, as denoted by A of FIG. 9, extends between bottoms of recessed parts 104 across a projection corresponding to discharging gap 34, thus extending over an increased distance. For this reason, Xe in discharge gas is more likely to be excited. Controlling the discharge and increasing the efficiency are thus compatible with each other. Since the discharge takes place only at the bottoms of recessed parts 104, instead of being caused in the center of the cell, the discharge can be distributed among other places in the cell.

Figure 10:
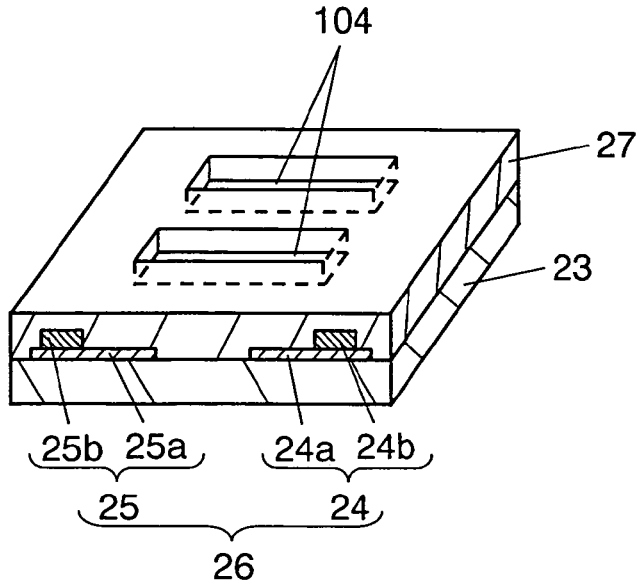
FIG. 10 is a perspective view illustrating the structure of a part corresponding to a discharge cell of a panel of a plasma display device in accordance with a still further exemplary embodiment of this invention.
Figure 11:
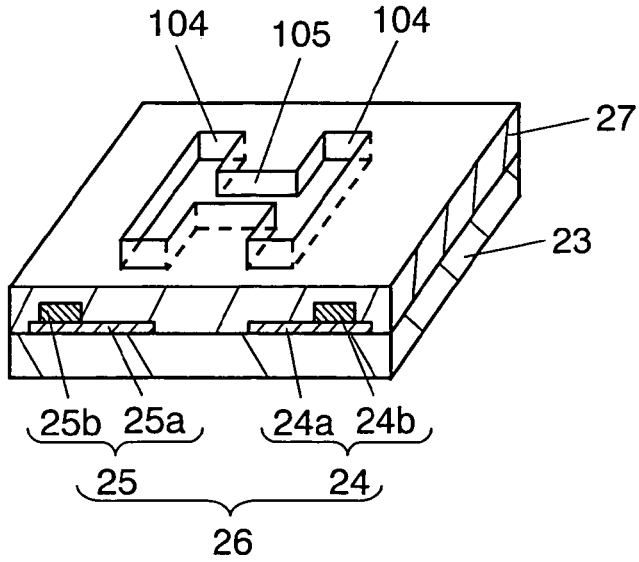
FIG. 11 is a perspective view illustrating the structure of a part corresponding to a discharge cell of a panel of a plasma display device in accordance with another exemplary embodiment of this invention.
Figure 12:
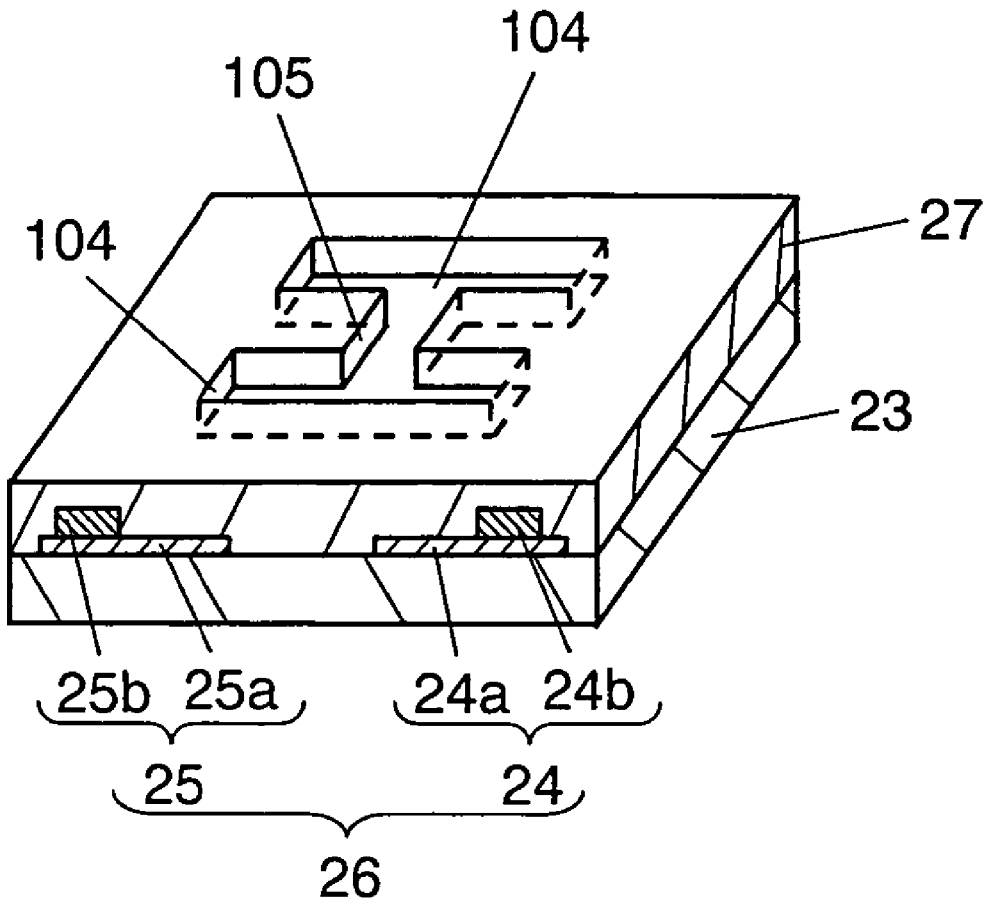
FIG. 12 is a perspective view illustrating the structure of a part corresponding to a discharge cell of a panel of a plasma display device in accordance with still another exemplary embodiment of this invention.
Figure 13:
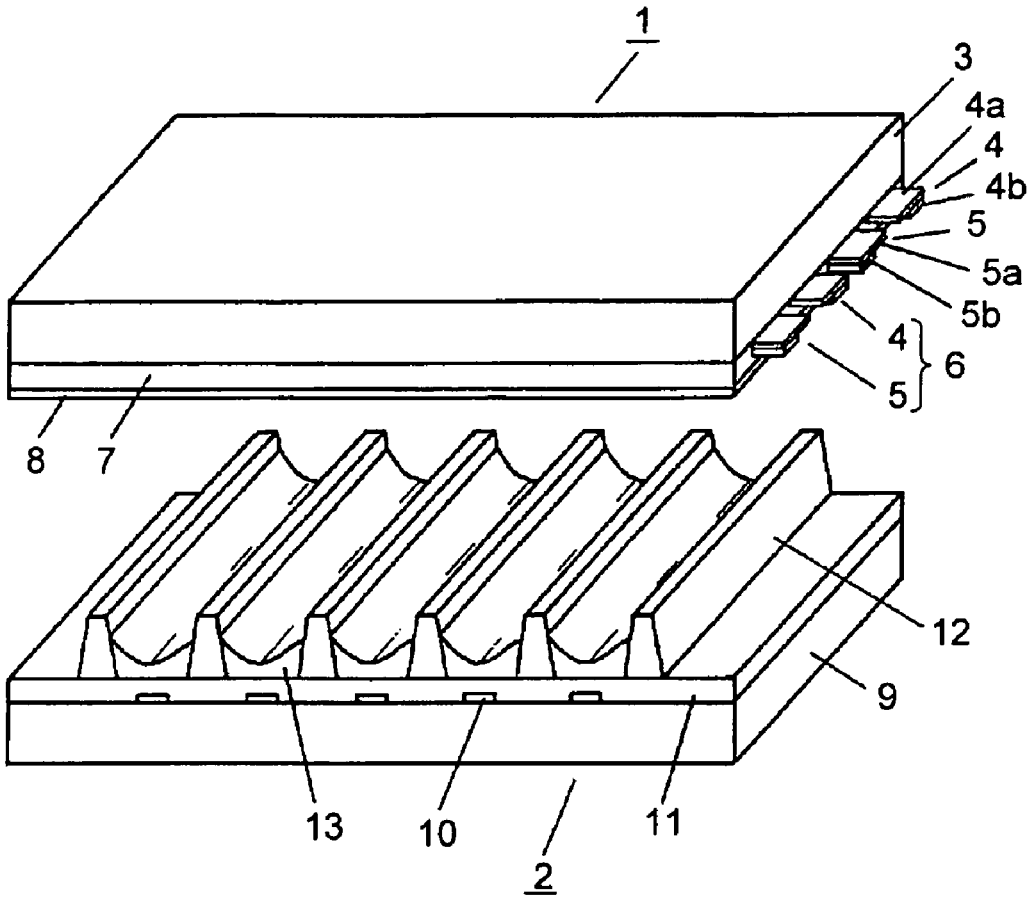
FIG. 13 is a perspective view illustrating the structure of a panel of a conventional plasma display device.
Figure 14:
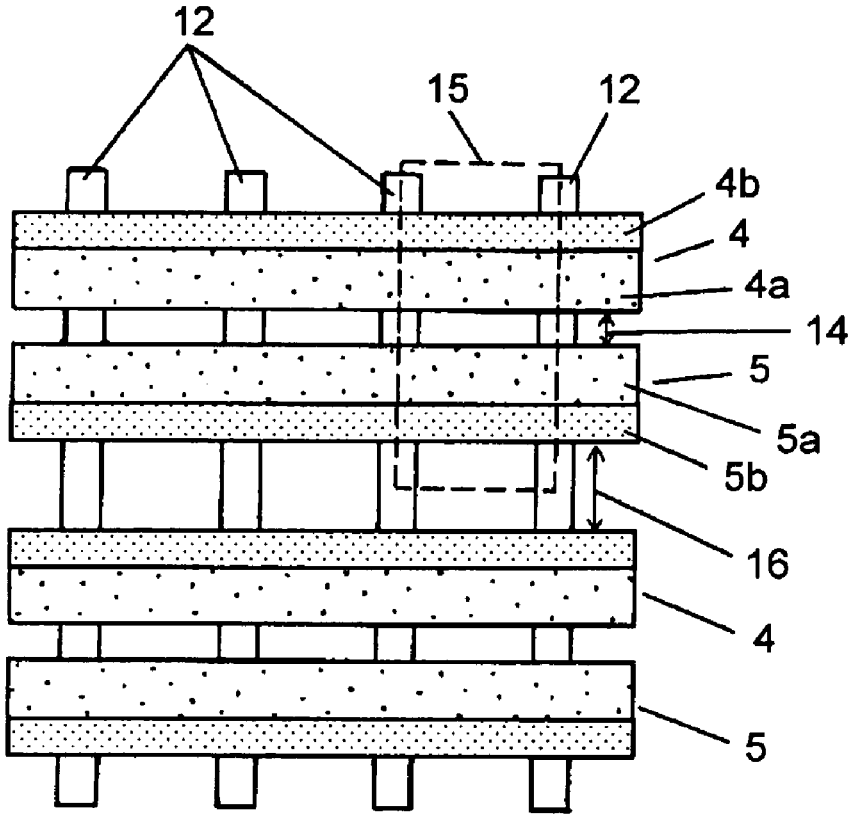
FIG. 14 PRIOR ART
FIG. 14 is a plan view illustrating the structure of discharge cells of the conventional plasma display device.

FIGS. 10–12 each illustrate the structure of a part corresponding to a discharge cell in a panel of a plasma display device in accordance with another exemplary embodiment of this invention. In the example illustrated by FIG. 10, recessed parts 104 formed in dielectric layer 27 are located inwardly of bus electrodes 24*b*, 25*b* and barrier ribs 32 (FIG. 1), and are arranged side by side in a direction orthogonal to display electrode 26 and are separate from each other like islands.

FIGS. 11 and 12 illustrate examples corresponding to FIGS. 8 and 10, respectively. In each of these examples, at least one groove 105 is formed to connect recessed parts 104 in each discharge cell. With at least one groove 105 thus formed to connect recessed parts 104 in each discharge cell, discharge can originate from this groove 105, which is given a role as a pilot light for the discharge. Accordingly, discharge voltage can be reduced, and consequently, efficiency can be improved. In other words, since the discharge can originate from groove 105, groove 105 ensures the reduction of the discharge voltage, while two recessed parts 104 can ensure an increase in the distance covered by the discharge.

In each of the above-described embodiments of the present invention, dielectric layer 27 may be constructed of at least two layers of different dielectric constants and may be formed with, at its surface closer to the discharge space, recessed part 100, 101, 102 or 103 or recessed parts 104 with or without groove 105 in each discharge cell. In this case, the dielectric layer, formed above the bottom of recessed part 100, 101, 102, 103 or 104, and which is closer to the discharge space, has a lower dielectric constant, so that the amount of charges to be stored above this dielectric layer can be reduced. Consequently, undesirable discharge between the cell and its adjacent cell can be prevented.

Red, green and blue phosphor layers 33 may successively be deposited, corresponding to the respective discharge cells, and the size of recessed part 100, 101, 102, 103 or 104 in each discharge cell may be varied depending on the color of phosphor layer 33. In this case, light emission can be controlled by the size of recessed part 100, 101, 102, 103 or 104. For example, if a bottom of recessed part 100, 101, 102, 103 or 104 corresponding to blue has an area more than that of a bottom of each of recessed parts 100, 101, 102, 103 or 104 corresponding to green and red, respectively, color temperature can be improved. Further, in combination with a high Xe partial pressure, recessed parts 100, 101, 102, 103 or 104 varying in size among the colors of phosphor layers 33 can enhance their effect.

INDUSTRIAL APPLICABILITY

In the plasma display device of the present invention described above, the discharge space is filled with the discharge gas or mixed gas including Xe, the partial pressure of which ranges from 5% to 30%, and the dielectric layer is formed with, at its surface closer to the discharge space, the recessed part(s) in each discharge cell. Accordingly, the discharge can be controlled, and the efficiency improved by the high Xe partial pressure can be utilized effectively. Consequently, the efficiency and image quality of the PDP can be improved.

The invention claimed is:

1. A plasma display device comprising:

a front substrate;

a back substrate opposed to said front substrate so as to form a discharge space between said front substrate and said back substrate;

a plurality of barrier ribs provided in said discharge space so as to partition said discharge space;

a plurality of display electrodes disposed on said front substrate so as to form a plurality of discharge cells between said barrier ribs;

a dielectric layer disposed above said front substrate so as to cover said display electrodes; and a phosphor layer which emits light by discharge between said display electrodes, wherein said dielectric layer is constructed of at least two layers of different permittivities, said at least two layers comprising an upper layer and a lower layer, wherein said upper layer of said dielectric layer is disposed so as to be closer to said discharge space than said lower layer, wherein said lower layer of said dielectric layer is disposed so as to cover said display electrodes, wherein a permittivity of said upper layer of said dielectric layer is smaller than a permittivity of said lower layer of said dielectric layer, wherein, in each of said discharge cells, said upper layer of said dielectric layer is formed with a substantially square shaped recessed part, and wherein said substantially square shaped recessed part is formed with corner portions thereof that are rounded.

2. The plasma display device of claim 1, wherein, in each of said discharge cells, said upper layer of said dielectric layer is provided with at least two recessed parts, and at least one groove is formed therein to connect said at least two recessed parts.

3. The plasma display device of claim 1, wherein a plurality of phosphor layers having respective colors of red, green and blue are successively deposited and correspond to respective ones of said discharge cells, and wherein, in each of said discharge cells, a size of said recessed part varies depending on the color of the phosphor layer.

* * * * *